United States Patent [19]

Ohno et al.

[11] Patent Number: 4,549,803

[45] Date of Patent: Oct. 29, 1985

[54] RECORDING APPARATUS

[75] Inventors: Akio Ohno, Kawaguchi; Kenji Takeda, Kawasaki, both of Japan

[73] Assignee: Canon Kabushiki Kaisha, Tokyo, Japan

[21] Appl. No.: 597,278

[22] Filed: Apr. 6, 1984

[30] Foreign Application Priority Data

Apr. 12, 1983 [JP] Japan ..... 58-63075
Oct. 18, 1983 [JP] Japan ..... 58-195758

[51] Int. Cl.[4] ..... G03G 15/20

[52] U.S. Cl. ..... 355/14 FU; 355/3 FU; 355/15; 219/216; 219/388; 219/469

[58] Field of Search ..... 355/14 FU, 3 FU, 15, 355/3 R, 4; 219/216, 388, 469–471; 34/52

[56] References Cited

U.S. PATENT DOCUMENTS 3,588,445 6/1971 Hopkins ..... 219/469 X
3,861,860 1/1975 Thettu et al. ..... 355/15 X
4,373,801 2/1983 Itoh ..... 355/14 FU
4,391,509 7/1983 Cavagnaro ..... 355/3 FU

FOREIGN PATENT DOCUMENTS 0088475 6/1982 Japan ..... 355/14 FU
0109969 7/1982 Japan ..... 355/14 FU
0201273 12/1982 Japan ..... 355/14 FU

*Primary Examiner*—R. L. Moses
*Attorney, Agent, or Firm*—Fitzpatrick, Cella, Harper & Scinto

[57] ABSTRACT

The present invention provides an apparatus wherein image fixing means is controlled for different fixing conditions under which a toner image is fixed on a recording material to adapt it to a synthetic resin sheet as the recording material or to a color image to be fixed, including at least one of fixing temperature, fixing speed and actuation of cleaning means. The present invention is particularly effective in use for a recording system in which the fixing temperature and speed are decreased and the cleaning means is actuated when a color image is to be formed on a transparent or resin sheet. The present invention is most useful for a color image recording system.

24 Claims, 5 Drawing Figures

RECORDING APPARATUS

BACKGROUND OF THE INVENTION

1. Field of the Invention

The present invention relates to an apparatus for fixing and recording toner images on various different recording materials. The present invention is particularly advantageous upon recording colored images, and can be applied to all of the types of image forming and recording systems which have currently been utilized, such as copying machines, laser printers, printing machines, facsimiles and others.

2. Description of the Prior Art

The prior art includes Japanese Patent Publication No. 51-10490 in which toner images are fixed to recording materials taking account of the thickness or color thereof, and Japanese Laid-open Patent Application Nos. 51-78342 and 52-20841 in which attention is paid to the color of toner images.

Of these Publications, Japanese Patent Publication No. 51-10490 discloses controlling temperature of fixation so that it is increased as the thickness of recording materials increases. Such a method can follow the different thickness of the recording materials but not the kind of toner images to be fixed on recording materials and the property of the recording materials. In addition, if the temperature of fixation is simply changed, there is produced an "offset" phenomenon in which a toner image is undesirably transferred onto the surface of a contact heating type fixing roller that is recently being utilized wide in the art.

On the contrary, Japanese Laid-open Patent Application Nos. 51-78342 and 52-20841 disclose a technical concept in which paper with an increased thickness is more slowly moved under a radiantly heating lamp of non-contact fixture type when a multicolor toner image is formed thereon in comparison with case where a single-color toner image is formed on paper with a reduced thickness in a color copying machine. However, they are irrelevant to a problem with respect to offset, which will be described hereinafter, since the non-contact type lamp is used therein, and have no teaching as to how to meet the property change and state change of the recording material. In addition, the temperature of fixation is maintained constant in either of the monochromatic or multi-color toner image.

It has also been proposed that the speed of recording paper at which it is being moved between a pair of fixing rollers is changed depending upon the thickness of that recording paper at a constant temperature. However, such a proposal has no variable control to meet variations in recording material and/or colored toner image, and no temperature control.

Under such a state and tendency of art, the present invention is directed to a recording system which can satisfactorily overcome various problems in the prior art, which will be described below.

First of all, the technical background concerning the present invention will first be described. The modern recording systems can utilize plain paper of various different types, such as thick paper, thin paper, postal or post cards and others. It is also strongly demanded to use synthetic resin films which is used in over-head projectors (hereinafter called simply "OHP"). In the prior art, toner images could only temporarily be fixed on the synthetic resin films for some period of time. And, the resulting images were rather easily be damaged and were not the faithfully reproduced images. Namely, the prior art systems does not provide a satisfactory formation of fixed images on the synthetic resin films with respect to fixation and sharpness.

The modern recording systems can provide both multi-color and monochromatic images, the monochromatic images being obtained with different colors respectively. In such a recording system that multicolor and monochromatic modes can selectively be changed from one to another, the fixation of multicolor images is inferior to that of monochromatic images. Therefore, "offset" toner will be increased in amount in the multicolor mode. This adversely affects the fixation of monochromatic image fixation and additionally highly decrease the ability of a rotatable fixing member which contacts the toner images for fixation. Consequently, the rotatable fixation member must frequently be exchanged.

When images are to be recorded on synthetic resin films, the above problem with respect to the rotatable fixation member contacting the toner images cannot be avoided because of the decreased ability of fixation and more offset toner. It is substantially impossible to record colored toner images, particularly on transparent film of synthetic resin, which is more strongly required in the art. There are many newly created problems relating to sharpness, fixation and offset.

One of the newly created problems is that a greater amount of a toner image is transferred to a rotatable member such as a fixing roller, fixing belt or the like, which is used to fix the toner images onto synthetic resin film. In such a case, the rotatable member immediately becomes inoperative. Another problem is that the colored toner images are so unsatisfactorily fixed on the synthetic resin film that the resulting images are rather highly different from the original in color tone.

The problem of color tone associated with the formation of images on synthetic resin films will now be described.

Even if a color image is heatedly fixed on a synthetic resin film as in the prior art fixation of color image, the fixed image will have no practicable color tone when it is projected onto a screen through the OHP. For example, the projected image of yellow-colored toner becomes dark as a whole with the half-tone portion thereof being gray-colored. The projected images of cyan- and magenta-colored toners also become dark as a whole with the color tones being shifted into light green- and red-colors, respectively. This is not practicable.

SUMMARY OF THE INVENTION

It is a primary object of the present invention to extend the service life of a rotatable member for fixing toner images.

Another object of the present invention is to improve the fixation of toner images to synthetic resin films.

Still another object of the present invention is to improve the service life of a rotatable fixing member with respect to the synthetic resin films or color images.

A further object of the present invention is to provide a recording apparatus which can improve the fixation and greatly decrease the amount of offset toner independently of the types of recording material.

A further object of the present invention is to provide a recording apparatus which can form multicolor images on the synthetic resin films.

A further object of the present invention is to provide a recording apparatus which can properly and positively form multi-color images on the synthetic resin films, which can decrease the amount of offset toner transferred to a rotatable fixing member, and which can highly improve the service life of the rotatable fixing member.

These and other objects, features and advantages of the present invention will become more apparent upon a consideration of the following description of the preferred embodiment of the present invention taken in conjunction with the accompanying drawings.

The inventors have thought that the improved color tone of projected images on the screen can be obtained by sufficiently fusing the toner to increase the adhesiveness between the toner particle surfaces to provide a toner layer having uniform thickness and density as well as smooth surface and to minimize the air cavities.

The present invention is therefore aimed at a recording apparatus which can greatly improve the service life of a rotatable member such as a roller or belt which is used in fixation and which can increase the ability of fixation of images, particularly color images to synthetic resin films.

It is thought that undesirable phenomena with OHP images may result from the deflection and scattering of light created when the projecting light travels through the toner layer, and this is caused by, for example, the color toner being fixed on the film under a hemi-melting state to provide air cavities in the toner layer or by the surface of the toner layer being rough.

DESCRIPTION OF THE PREFERRED EMBODIMENTS

Figure 1:
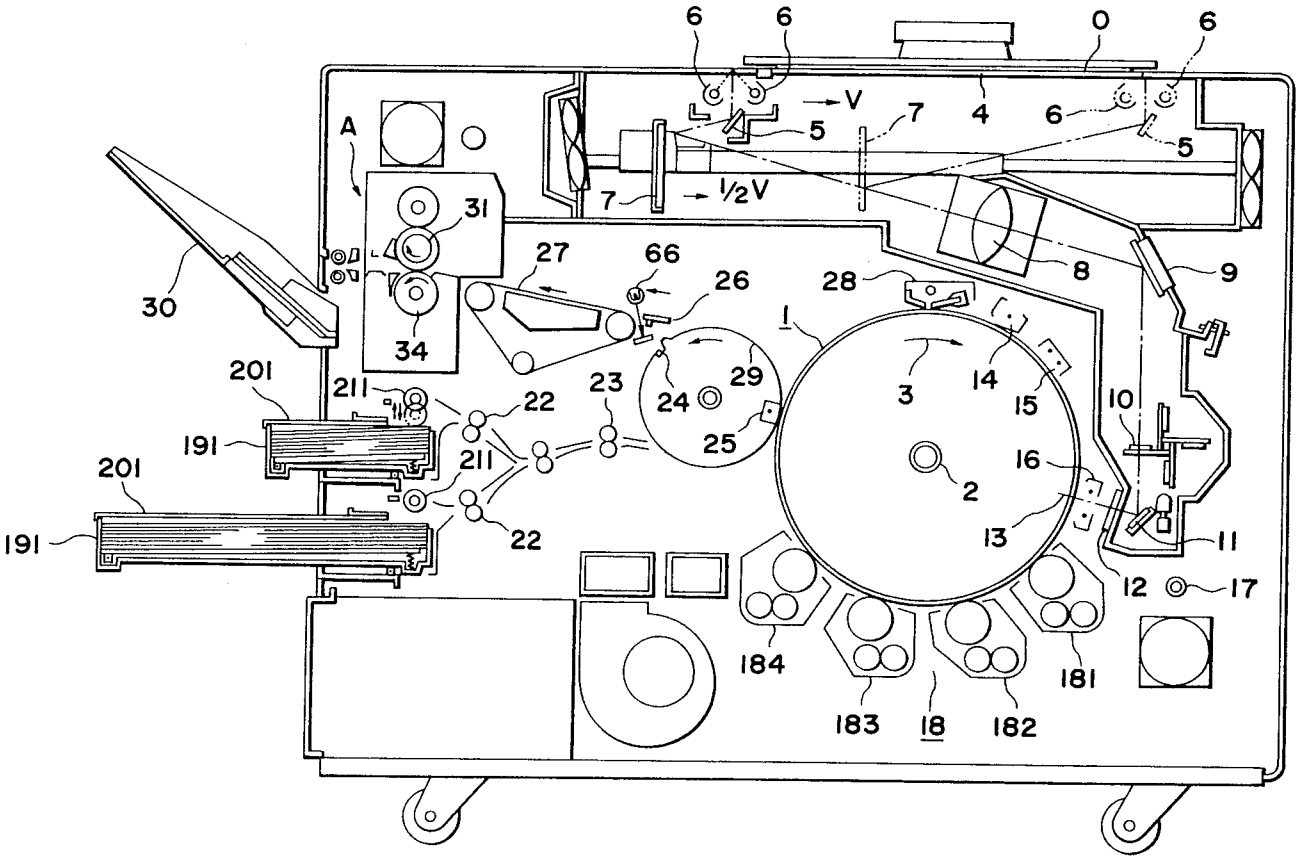
FIG. 1 is a schematic view of an electrophotographic type color recording apparatus to which the present invention is applied.

Referring now to FIG. 1, there is shown an electrophotographic type color copying system which comprises an electrophotographic type photosensitive drum 1 having an insulation surface layer and rotatably supported by a shaft 2. Receiving a copy instruction, the drum 1 begins to rotate in the direction of arrow 3. When the drum 1 is rotated to a predetermined position, an original O placed on a platen 4 of transparent glass is illuminated by an illuminating lamp 6 formed integrally with a first scanning mirror 5 with the reflected light therefrom being reflected by a second scanning mirror 7. The first and second scanning mirrors 5 and 7 are together moved at a speed ratio of 1:½ so that the optical path length between the original O and a lens 8 will be maintained constant while scanning the original O. The reflected light image is directed through the lens 8 and a third mirror 9 to a color separation filter 10 whereat it is subjected to color separation. The light is then imaged on the drum 1 through a fourth mirror 11 and a dustproof glass 12 at an exposure station 13.

The drum 1 is electrically discharged by a charge remover 14 and then charged to positive polarity by a primary charger 15. The drum 1 is thereafter exposed through a slit to the image light which has been provided by the illuminating lamp 6 and so on at the exposure station 13. Simultaneously, the drum is electrically discharged by a discharger of AC or having the opposite polarity component (for example, negative) to the polarity of the primary charger 15 by a charge remover 16. Subsequently, the drum 1 is subjected to a whole surface exposure by a whole surface exposure lamp 17 such that an electrostatic latent image having a high contrast is formed on the drum 1.

The electrostatic latent image on the photosensitive drum 1 is then visualized into a toner image by a developing device 18. The developing device 18 includes four developing units of yellow 181, magenta 182, cyan 183 and black 184 one of which is selected in response to the color separation filter used on exposure to obtain a toner image having the desired color (single-color, multi-color or full-color).

A cassette 191 contains recording materials 201 which are supplied one at a time to the machine by means of a feed roller 211. The supplied recording material is timed roughly by first registration rollers 22 and then precisely timed by second registration roller 23, and the leading edge of the recording material is grasped by a gripper 24 on a transfer drum 29 which will be described hereinafter in detail. As the transfer drum 29 is being rotated, the recording material 201 is wound and conveyed around the transfer drum 29. As the recording material 201 is moved between a transfer charger 25 on the transfer drum 29 and the photosensitive drum 1, the toner image is transferred from the photosensitive drum 1 onto the recording material 201. The transfer drum 29 rotates through a desired number of complete revolutions while grasping the leading edge of the recording material 201 at the gripper 24. Thus, the desired number of color images are transferred onto the same recording material.

It is noted that the illustrated copying machine comprises two cassettes which contain recording materials of different sizes and is adapted to supply recording materials of one of the sizes which is selected in response to instructions.

Upon completion of the transfer step, the recording material 201 is released from the gripper 24 and conducted onto a conveyor belt 27 by means of a separation pawl 26. The recording material is then conveyed into the nip between fixing rollers 31 and 34 used as thermally fixing rotatable means which at the toner image is fixed to the recording material. Finally, the recording material having the fixed image thereon is discharged into a tray 30. After the transfer step, the photosensitive drum 1 is cleaned at its surface by means of a cleaner 28 including a resilient blade, and then ready for the next cycle.

Figure 2:
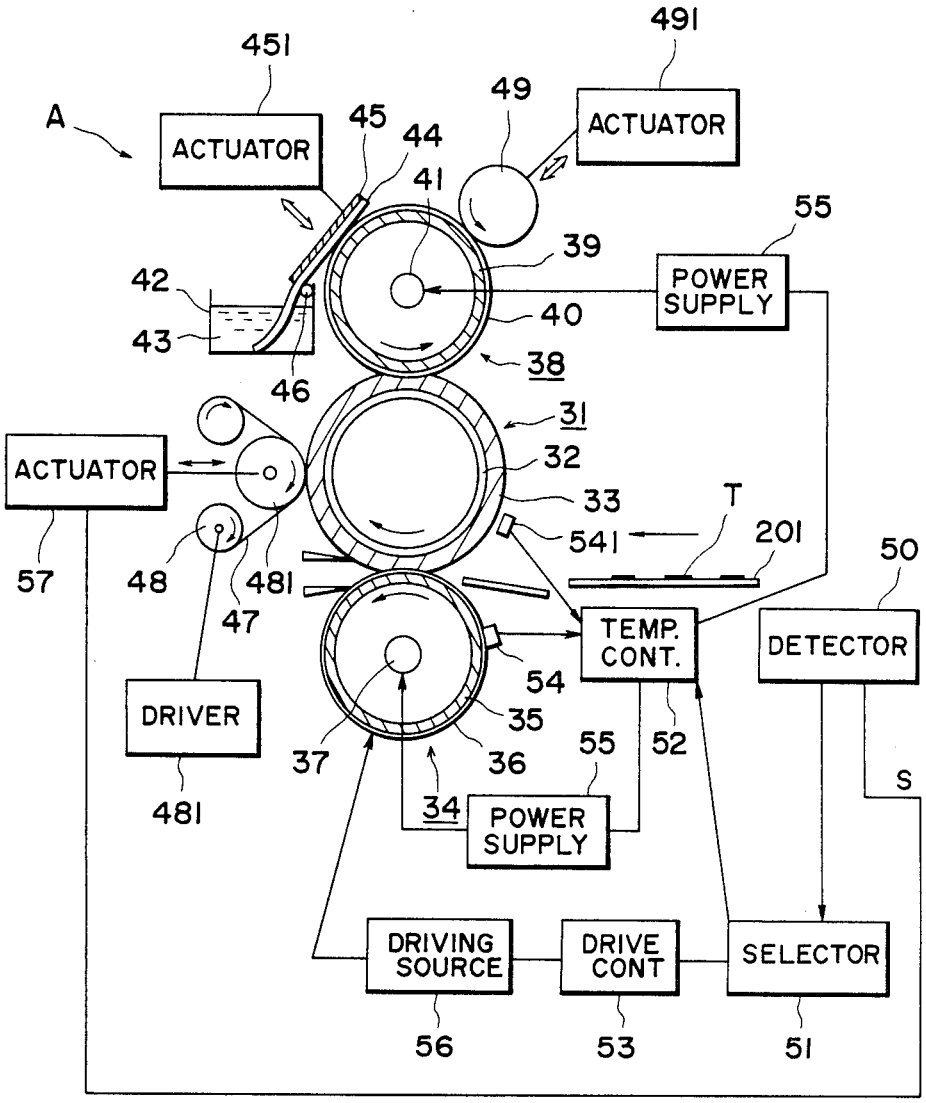
FIG. 2 illustrates the operation and construction of a fixing portion in the apparatus according to the present invention.

FIG. 2 shows the detailed construction of the fixing means A including the fixing rollers 31 and 34 and associated control blocks.

One of the fixing rollers 31 is in the form of a metallic pipe 32 which is covered by a layer 33 of RTV silicone rubber throughout the peripheral surface thereof. The fixing roller 31 is engaged and heated by a roller 38. The other fixing roller 34 includes a metallic pipe 35 and a layer 36 of synthetic resin such as Teflon (trade mark of Du Pont) covering the peripheral surface of the pipe and including a infrared lamp type heater 37 disposed therein. These thermally-fixing rollers 31 and 34 serves to cause the recording material to be subjected to the fixing process.

The roller 38 engaging the roller 31 under pressure includes a metallic pipe 39 and a layer 40 of synthetic resin such as tetrafluoroethylene covering the metallic pipe 39 and including an infrared lamp type heater 41 located therein, as in the roller 34.

A container 42 containing silicone oil 43, which is dipped out and applied to the surface of the roller 38 by an application felt 44. The silicone oil is then transferred from the surface of the roller 38 to the surface of the roller 31.

The application felt 44 is supported, together with a holding plate 45, by a rotating shaft 46. An actuator 451 consisting of an electromagnetic plunger and a tension spring, not shown, is provided to displace the application felt 44 between an application position in which the felt 44 contacts the roller 38 and a non-application position in which the felt 44 is spaced away from the roller 38.

A cleaning web 47 is provided to remove the "offset" toner from the surface of the roller 31 and so arranged that the web 47 is pressed against the roller 31 by a pressing rubber roller 481 which is adapted to move in the direction of arrow only when an image is to be fixed to a synthetic resin film for OHP or when a colored toner image is to be fixed to any recording material as will be described hereinafter. The cleaning web 47 is taken up around a take-up roller 48 while cleaning the surface of the roller 31 when the take-up roller 48 is driven by drive means 481. A cleaning felt roller 49 is also provided to remove the offset toner from the surface of the roller 38, which toner has been transferred from the roller 31 to the roller 38. The cleaning felt roller 49 is moved to engage the roller 38 by an actuator 491 when the rollers 31, 34 and 38 are positioned into pressure engagement with one another upon turn-on of a main switch. The cleaning web 47 may intermittently be driven.

The thermally-fixing rollers 33 and 34 are controlled by any known temperature control means such that the surface of the roller 34 opposite to the surface to which a toner image T is to be fixed has a temperature higher than that of the surface of the roller 33 which is adapted to contact the toner image T. In the illustrated embodiment, the heater 41 is controlled by non-contact type temperature detection means 541 located near the surface of the thermally-fixing roller 33 while the heater 37 is controlled by detection means 54 which will be described hereinafter.

The rollers 38 and 49 function to clean the surface of the fixing roller 31, and the roller 38 functions to heat the roller 31, as well.

The control system shown in FIG. 2 comprises recording material detection means 50 for detecting the sort of the recording material 201, whether it is paper or resin sheet or whether it is thick or thin. The detection means 50 may automatically or manually be actuated to generate a signal S indicative of the instruction or detection of a synthetic resin film for OHP. The signal S is then supplied to the actuator 47 which is in turn operated to drive the cleaning web 47 in the manner described above.

When cleaning means such as the cleaning web 47 is auxiliary operated against the fixing roller 31 on fixation of the toner image to the synthetic resin film, the service life of the fixing roller 31 can greatly be extended. Otherwise, a localized heat reduction on the fixing roller 33 and the transfer of more offset toner to the roller 33 would be produced since the offset toner has passed through the roller 38 which is effective to clean the fixing roller 33 during the normal fixation. As described hereinbefore, this is much influenced by the difficulty of the fixation of the toner image to the synthetic resin film.

In addition to such a problem, if the surface material of the fixing roller 33 is rubber material, the offset toner penetrates into the rubber material. This promotes the offset of the toner into the fixing roller surface and extremely reduce the service life of the fixing roller 33. If the auxiliary cleaning means is used with the synthetic resin film as in the illustrated embodiment, however, the service life of the roller 33 can be extended. Since the cleaning means is used in association with the synthetic resin films not with plain paper, the cleaning means also can be improved in service life.

In the illustrated embodiment, the above cleaning means is auxiliary operated also when a color image (multi-color or full-color) is to be fixed to the recording material in addition to the synthetic resin film used. This is adopted to overcome such a problem that the offset toner strongly adheres to the surface of the fixing roller upon fixation of the colored toner image because it is generally obtained from plural different kinds of toners which are stacked one over another or mixed one with another. The cleaning means is used only for the fixation of color images rather than single-color images for such a purpose that the service life of the cleaning means can be extended.

These problems becomes particularly remarkable when a color image is to be formed on a synthetic resin film, since the amount of the offset toner is added in combination. Therefore, the auxiliary cleaning means is extremely important in that the service life of the roller 33 can be extended.

The control system also comprises selector means 51 adapted to change the temperature T of the fixing roller set by temperature control means 52, which will be described hereinafter, and the speed V of the fixing roller set by drive control means 53 which will also be described hereinafter, depending on the sort of a selected recording material. The temperature and speed of the fixing roller are simultaneously increased or decreased together by the selector means 51. Thus, the ability of fixation suitable for the selected recording material can be provided by setting the temperature and speed of the fixing roller by the selector means 51.

In the illustrated embodiment, the temperature control means 52 comprises surface temperature detecting means 54 located in engagement with or near the surface of the roller 34, and power supply means 55 for controlling the electric power to the heaters 37 and 41 with respect to voltage or current. The drive control means 53 comprises drive supply means 56 including a drive motor, reduction gears, clutches and others which can control the speed of the roller 34 directly or indirectly through the rollers 38 and 31.

If a recording material is supplied to the above apparatus in the above arrangement, a toner image of multi- or full-color will be formed on the recording material and then conveyed to the fixing device A shown in FIG. 2.

If this recording material is a sheet of ordinary thin paper which is normally frequently used, the thermally-fixing roller 34 is controlled to have a setting temperature $T_0$ and a setting speed $V_0$ such that a color image is more strongly be fixed to the recording material with an increased sharpness. If the recording material is in the form of a synthetic resin film for OHP, which will be called also as transparent material, the roller 34 will be controlled to have a setting temperature $T_2$ ($<T_0$) and a setting speed $V_2$ ($<V_0$) such that a color image having its increased sharpness and fixation will be obtained with the light transmitting therethrough being very bright. If the recording material is a sheet of thick paper, the fixing roller 34 is controlled to have a setting temperature $T_1$ ($<T_0$) and a setting speed $V_1$ ($<V_0$) as in the transparent material. This also provides a color image having its increased sharpness and fixation.

By selecting the setting temperature and speed, color images which are superior in fixation and brightness and have a reduced offset amount were obtained for the respective recording materials. Also, the service life of the fixing roller was greatly extended.

Figure 3:
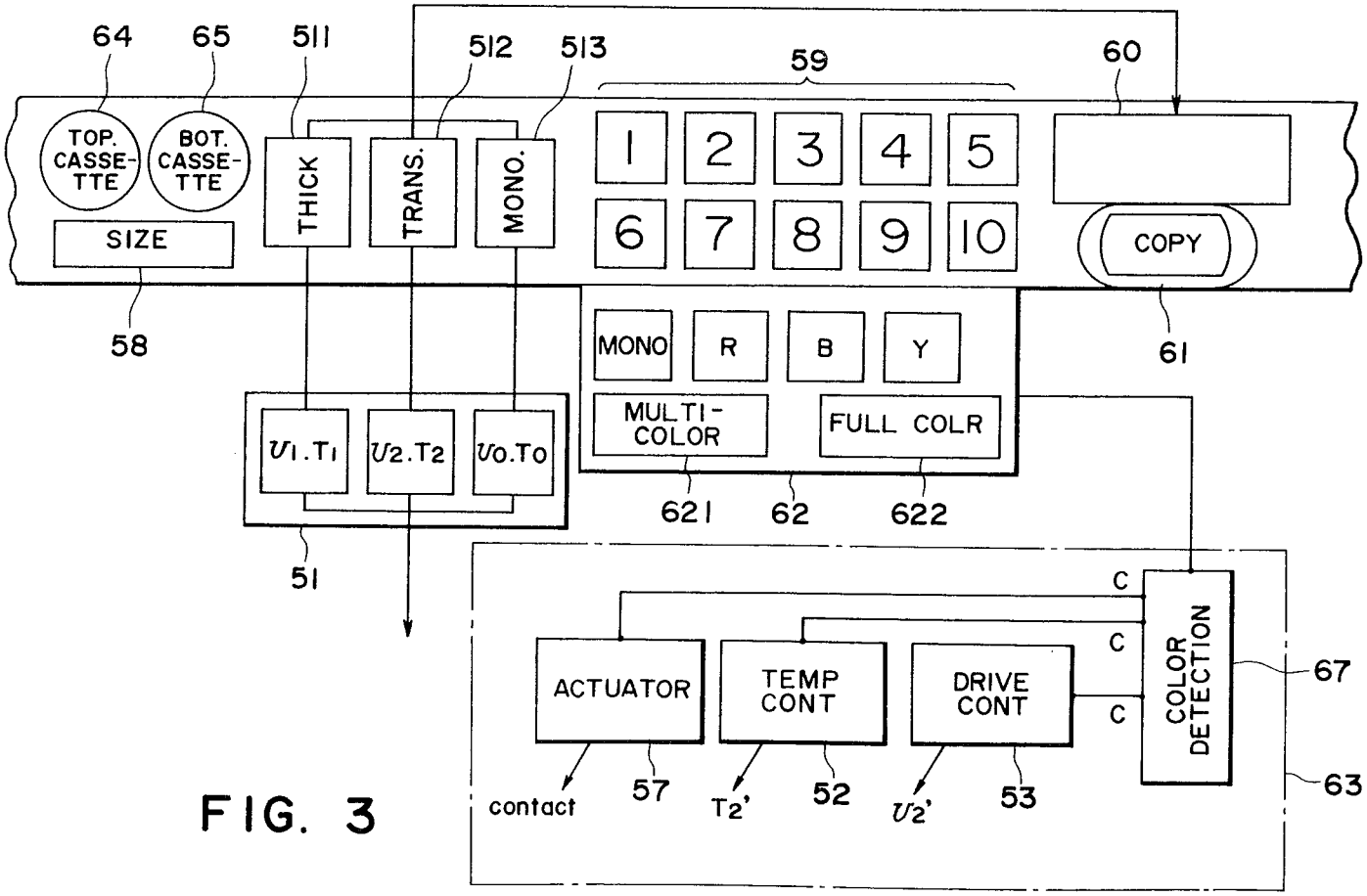
FIG. 3 illustrates the operation of an operational portion in the apparatus according to the present invention.

FIG. 3 shows manual type recording material detection means for detecting the sort of the recording material while FIG. 1 shows automatic detection means 66 for discriminating whether or not the recording material is transparent, depending on the transmittance at the recording material. In any event, there is provided manual or automatic means which generates a signal indicative of the sort of a selected recording material.

The manual type operation section shown in FIG. 3 comprises a key 511 for instructing the use of a thick recording material, a key 512 for instructing the use of a transparent recording material, and a key 513 for instructing the use of ordinary paper which is normally in its depressed position. The keys 511, 512 and 513 respectively correspond to the setting speeds and temperatures programmed in the selector 51 as described previously. The key 511 corresponds to the setting speed and temperature $V_1$, $T_1$; the key 512 to the setting speed and temperature $V_2$, $T_2$; and the key 513 to the setting speed and temperature $V_0$($>V_1$, $V_2$), $T_0$ ($>T_1$, $T_2$). If the key 513, for example, is turned on, thus, the speed and temperature of the rotatable fixing means will manually be set to "$V_0$" and "$T_0$", respectively.

There is also provided a key 59 for setting the number of copies to be continuously reproduced with this number being indicated in a display 60. The start of the system is effected by operating a copy key 61. The upper and lower cassettes shown in FIG. 1 are selected by operating keys 61 and 65, respectively. The size of recording materials contained within the selected cassette is indicated in a display 58.

There is further provided a manual operating board 62 for instructing the color of an image to be copied and which has mono-color keys for selecting developers of different colors, and multi-color and full-color keys 621, 622 for selecting the combination of the above colors. By selecting one of these keys, one can determine the desired color degree of an image (the original itself is colored on full-color).

Since the system is so constructed that proper setting speed and temperature can be selected depending on the sort of a recording material to which a toner image is to be fixed, problems with respect to reduced fixation and remarkable offset can be overcome. In other words, the ability of fixation can properly be improved to prevent the offset of developers independently of the sort of a recording material to be used. Consequently, the service life of the rotatable means for fixing the toner image can greatly be improved. Furthermore, the entire operation of the system can be improved by using the auxiliary cleaning means for the fixing roller when the synthetic resin film tending to create the offset is used.

Particularly, when a transparent recording material is used in the full-color mode, the fixation is improved while greatly reducing the offset with sufficient amount and time of heating being positively provided. Thus, the toner particles are sufficiently fused and bonded with one another to provide a uniformalized toner image through which light can uniformly pass toward a predetermined position without scattering. An image fixed to the transparent recording material in the full-color mode had a bright color properly reproduced.

Further, the advantages of this embodiment will now be described with reference to actual numerical value.

The system shown in FIG. 2 had the rollers 34 and 38 each having a diameter of 50 mm and a surface layer 36 or 40 of 25$\mu$ thickness, and the roller 31 having a diameter of 60 mm and its rubber layer 33 of 5.5 mm thickness. Each of the rollers 34 and 38 had a halogen lamp of 800 W contained therein.

For ordinary thin paper currently used as recording materials, the setting surface temperature of the roller 34 was 150° C. and the temperature of the roller 31 was 145° C. with the peripheral speed of each of the rollers being set at the same speed as in the process speed, 150 mm/sec. when toner images were fixed to the recording materials in the full-color mode. There were obtained fixed images each having a bright color and an appropriate brilliance. There was also no curling in the recording materials.

For synthetic resin OHP films, the surface of the roller 34 had a setting temperature of 135° C., the surface of the roller 31 had a setting temperature of 140° C. and the peripheral speed of each of the rollers 31, 34 was set at 30 mm/sec. which was substantially later than the process speed, in full-color mode.

Each film was held by the gripper 24 on the transfer drum 29 and then wound around the transfer drum. After the transfer drum had been rotated through a predetermined number of revolutions to transfer a predetermined number of images to the film, the latter was released from the gripper 24 and conducted onto the conveyor belt 27 by the separation pawl 26. At this time, the synthetic resin film was detected by the transmissive light detection means 55 including a light source and a light receiving element. The detection means 55 then generated a signal which is in turn supplied to actuate the separation pawl 26. Simultaneously, the peripheral speed of each of the rollers 31 and 34 in the fixing system A was changed to 30 mm/sec. through an electrostatic clutch and gear mechanism (not shown). If the fixing system A has received the signal from the detection means 55 or a signal previously supplied manually thereto which is indicative of a synthetic resin film, the rollers 34 and 31 was controlled to be 135° C. and 140° C., respectively. Thus, the film was conveyed through the fixing system at a relatively low speed and then discharged into the tray 27.

Thus, the resulting images fixed to the synthetic resin film indicated bright colors when projected.

When images was experimentally fixed to an ordinary paper under the same conditions as abovedescribed for the OHP film, the resulting images had no bright color with increased offset, increased luster and increased curling. Further, the parting material surface of the roller 31 functioned satisfactorily only for 9,000 sheets which is about one-half the satisfactory number of sheets when the conditions are set for the ordinary paper as described above.

On the contrary, when the synthetic resin materials were used under the same conditions as in the ordinary paper, the fixing roller 31 could not effect several fixations for the film. Additionally, when the cleaning web 47 is not used either, the fixing roller 31 was usable for only one fixation. When the cleaning web 47 was used under the same conditions, only ten film could be fixed. When the cleaning web 47 was used under the conditions, described above, for synthetic resin film, full-color images could be formed on several thousands of films.

The inventors carried out the following tests.

When polyester films of 100 μm thickness and sheets of ordinary paper of 80 g/m$^2$ are used in the above-mentioned fixing system, the following tables show hot-offset-points obtained as the thermally fixing roller 31 is changed into various setting temperatures and peripheral speeds (the "hot-offset-point", which will be called "H.O.T." hereinafter, indicates the surface temperature of the thermally-fixing roller when a toner image begins to be transferred from the recording material to the parting material surface of the roller as the temperature is gradually increased on the thermally-fixing roller), the surface temperature of the thermally-fixing roller when desired full-color images are obtained for the OHP films (when projected) and for the ordinary paper (hereinafter called "S.T."), and cold-offset-points of the thermally-fixing roller (the "cold-offset-point" which will be called "C.O.T." indicates the surface temperature of the thermally fixing roller when non-fused toner will be offset to the roller as the surface temperature of the thermally fixing roller is gradually decreased).

TABLE 1

| | OHP film | | |
|---|---|---|---|
| | 150 mm/sec. | 90 mm/sec. | 30 mm/sec. |
| H.O.T. | 170° C. | 165° C. | 155° C. |
| S.T. | 160° C. | 153° C. | 135° C. |
| C.O.T. | 145° C. | 130° C. | 108° C. |

TABLE 2

| | Ordinary paper | | |
|---|---|---|---|
| | 150 mm/sec. | — | 30 mm/sec. |
| H.O.T. | 165° C. | — | 148° C. |
| S.T. | 148° C. | — | 125° C. |
| C.O.T. | 135° C. | — | 103° C. |

Figure 4:
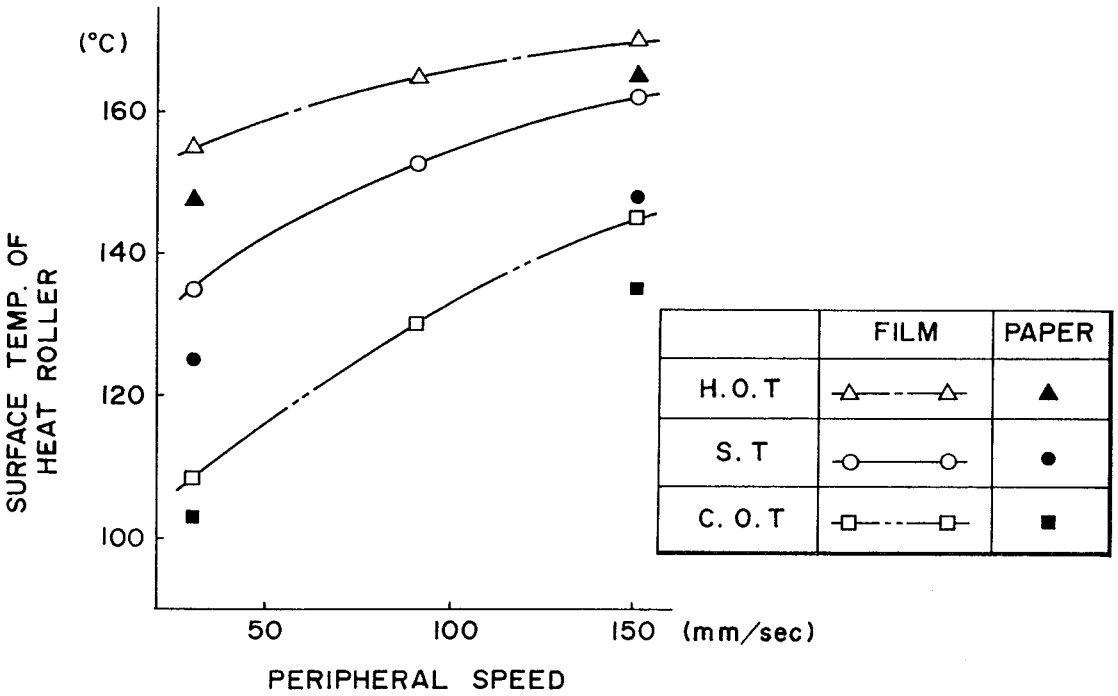
FIG. 4 is a graph showing the relationship between the peripheral speed and surface temperature in a fixing roller.

Data in the Tables 1 and 2 is plotted to form a graph shown in FIG. 4. In FIG. 4, the axis of abscissas indicates peripheral speeds of the thermally fixing roller while the axis of ordinates shows the surface temperatures of the thermally fixing roller 34.

From the above tables and FIG. 4, it is understood that the differences between H.O.T. and S.T. in the OHP films are 10° C. at 150 mm/sec. and 20° C. at 30 mm/sec. These differences are larger than the difference between H.O.T. and S.T. in the ordinary paper which is equal to 17° C.

In the Table 2, the data for the setting speed of 30 mm/sec. is indicated, but the recording materials could not actually be used due to curling.

Tests were carried out for durability in the fixing roller.

Under the fixing condition for ordinary paper, that is, such a condition that the thermally-fixing roller has its peripheral speed of 150 mm/sec. and its surface temperature of 148° C., images were continuously fixed on OHP films. These images were full-color images having three colors; cyan, magenta and yellow. When 1200 films were used, there was an offset phenomenon which provided undesirable copy images.

Continuous fixation of OHP films was similarly carried out in accordance with the present invention under such a condition that the thermally fixing roller had a peripheral speed of 30 mm/sec. and a surface temperature of 135° C. After 3000 sheets had been used, no offset was found. When the resulting images were projected through OHP, there were obtained improved chroma and brightness and yet substantially the same hue as when a colored toner image was observed in the film placed on white paper under reflection. The clear hue was the one not obtained under the fixing condition for the above recording materials. The resulting color tone was substantially the same as that obtained when the thermally-fixing roller had a peripheral speed of 30 mm/sec. and a surface temperature of 148° C.

Thus, the present invention provides a color image forming system which can properly carry out the fixation with respect to each of the OHP film and ordinary paper. When the fixation is particularly effected for the OHP film, bright color can be obtained while improving the parting material of the thermally-fixing roller in durability.

As seen from the foregoing, the present invention can select the setting temperature and speed of the rotatable fixing means such as roller or belt which are together increased or decreased depending on the sort of the recording materials. Thus, toner images can positively and properly be fixed to any kind of recording materials with the greatly reduced offset.

When the present invention is applied to a color recording apparatus, superior advantages can be obtained for any kind of recording materials including ordinary paper and synthetic film as aforementioned Although the previously described embodiment has been described as a rotatable fixing member which is in the form of the roller 34 remote from the toner image. This is advantageous since the amount of heat for the recording materials can stably be obtained independently of the ambient atmosphere. The roller 34 may be replaced by a rotatable member directly contacting the toner image, for example, the roller 31.

As described in connection with FIG. 3, the conventional color recording system forms images in two roughly classified modes, when the entire image is monochromatic (one of black, red, blue or yellow) and when a image has the combination of two (multi-color) or three (full-color) of the those. As described in connection with the auxiliary cleaning means, the offset may highly be created in the multi- and full-color modes rather than the monochromatic mode.

It is preferred that signals corresponding to only the multi- and full-colors are created to actuate the cleaning means as in the full-colors fixation of said synthetic resin film, described above. This is depicted by a block 63 in FIG. 3. If the offset of toner is created even by actuating the cleaning means, the latter would move violently be worn and have to be frequently replaced with the cleaning effect being reduced. Therefore, the fixation should be improved. For this purpose, it is preferable to rotatable the fixing roller at a speed lower than that of the monochromatic mode when the fixing roller is used for the fixation of color image or to reduce the temperature of the fixing roller in addition to the lower speed. More particularly, in FIG. 2, there is provided color detection means 67 for detecting the formation of color images when the multi- and full-color keys 621, 622 are turned on. When the color detection means 67 generates a signal C upon detection of the formation of a color image, the signal C is used to actuate the actuator 57 for moving the cleaning means 47 against the roller, to energize the drive control means 53 in addition to the energization of the actuator 57 to decrease the peripheral speed of the rollers 31 and 34 into a speed $V_2'$ smaller than the monochromatic reproduction speed $V_0'$, or to energize the temperature control means 52 in addition to the energization of the actuator and drive control means 57, 53 to set the temperature of the rollers 31 and 34 at a temperature $T_2'$ lower than that $T_0'$ of the monochromatic mode.

It is preferred that the speed and temperature $V_2'$, $T_2'$ are changed into such speed and temperature $V_2$, $T_2$ as in the previous embodiment, which are used to fix a full-color image to a synthetic resin film when the transparent key 512 is turned on.

Figure 5:
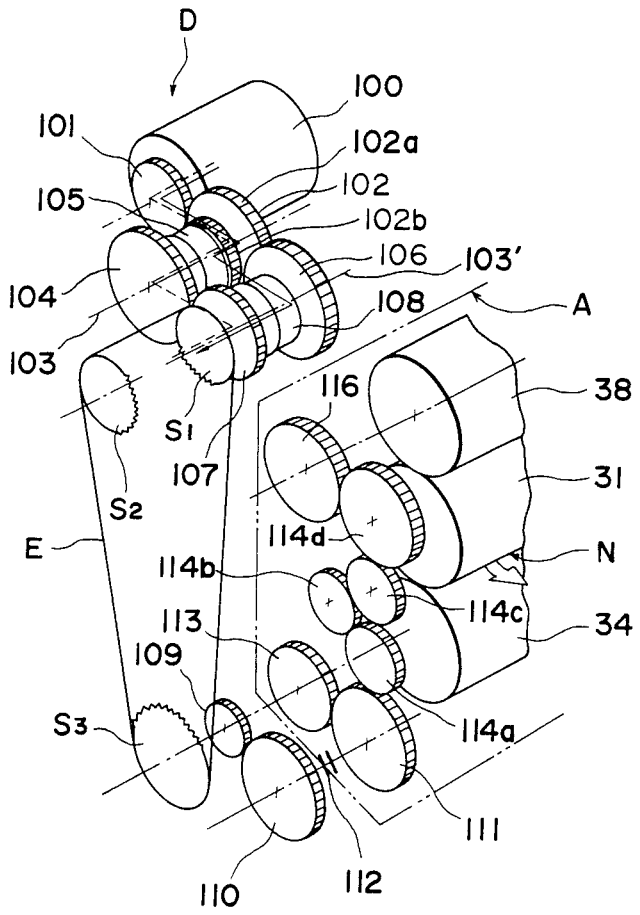
FIG. 5 is a perspective view of a drive transmitting mechanism used in the fixing device according to the present invention.

FIG. 5 shows a drive transmitting member used in the drive supply means 56 shown in FIG. 2 in which the drive transmitting member is controlled by the drive control means 53 such that the rotational speed of the fixing rollers 31 and 34 is set for the synthetic resin films at a value smaller than that for the sheet of paper. It is of course that this drive transmitting member may be combined with the respective mechanisms shown in FIG. 2 for various purposes.

The image forming system includes a drive mechanism shown by D in FIG. 5 and which is disposed in place.

This drive mechanism D comprises a drive motor 100 and a gear 101 mounted on the output shaft of the motor. The gear 101 is meshed with a gear **102*a* integrally mounted on a shaft 103 disposed parallel to the motor shaft, of a gear member 102, which also includes a gear 102*b* mounted integrally thereon. The shaft 103 supports a gear 104 through a clutch 105, the gear 104 having a diameter larger than that of the gear 102*b*. The gear 102*b* engages an enlarged-diameter gear 106 mounted on a shaft 103' which is arranged parallel to the shaft 103. The shaft 103' also supports a gear 107 through a clutch 108. A sprocket wheel $S_1$ is fixedly mounted on the shaft 103' outside the gear 107 (opposite side to the gear 106**).

In such an arrangement, when the clutch 105 is disengaged and the clutch 108 is engaged, the drive of the motor 100 is transmitted to the sprocket wheel $S_1$ through the gears 101, **102*a* via the gears 102*b*, 106 and 103' as shown by solid line in FIG. 5. When the clutch 105 is engaged and the clutch 108 is disengaged, the driving force is transmitted from the motor to the sprocket wheel $S_1$ through the gears 101, 102*a*, 102*b*, 104 and 107 via the shaft 103' as shown by broken line in FIG. 5**.

By appropriately selecting gear ratios with respect to the intermediate gears **102*a*, 106, 104 and 107**, therefore, the sprocket wheel $S_1$ can selectively be rotated at one of two rotational speeds.

A chain E is spanned between the sprocket wheel $S_1$ and the other sprocket wheels $S_2$ and $S_3$ such that gears 109 and 110 mounted on the shaft of the sprocket wheel $S_3$ will be drived at the selected one of two rotational speeds.

The drive mechanism D is disposed within the image forming system to include the gear train from the drive motor to the gear 110.

As described hereinbefore; the system shown in FIG. 1 has a path along which the recording material are to be conveyed and in which the fixing apparatus A is arranged which include the fixing rollers 38, 31 and 34. The roller 38 has a shaft fixedly supporting a gear 116 at the outside end while the shaft of the roller 34 supports a gear 113 fixedly mounted thereon at the outer end.

The final output gear 110 in the drive mechanism is connected with a gear 111 in the fixing apparatus A through an appropriate coupling 112. The gear 111 engages the gear 113 to drive the roller 34. The gear 111 also engages the gear 116 through intermediate gears **114*a* through 114*d* to drive the roller 31. In the illustrated embodiment, the roller 38 is frictionally driven by the rollers 31 and 34**.

The selection of the fixing rollers into a second speed or a first speed smaller than the second speed is carried out as follows. When a transparent resin sheet is to be used, a transparent material mode switch on the operation panel is turned on to engage the clutch 108 to change the fixing rollers from the second speed to the first speed. When a sheet of ordinary paper is to be used, the above switch is turned off to engage the clutch 105 to return the fixing rollers to the second speed.

Alternatively, when the transparent resin sheet is to be used, this may be detected during the copy cycle to generate a signal which is in turn supplied to the clutch. For example, if light emitting and receiving elements are disposed near the paper guide, conveyor belt or any other suitable location in the path such that the amount of light travelling between the light emitting and receiving elements during the passage of a recording material therebetween is previously determined by the use of clock pulses, the recording material may be moved at its appropriate speed by engaging the clutch 8 when the above amount of light indicates a transparent material or by engaging the clutch 105 when the amount of light indicates a sheet of ordinary paper.

When a color image is carried on a transparent sheet and projected onto a screen, the projected light is complicatedly deflected since the surface of the toner image is reduced in flatness if any non-fused toner particles exist on the toner image. If air cavities are formed between the non-fused toner particles having irregular surfaces in the toner layer, the projected light will have less parallel moving light beams to adversely affect the projected image through the entire thickness of the toner layer. In such a case, the conditions of fixation is required to be more severe than those required when the image is observed under any reflective light. This problem has been solved in accordance with the present invention.

While the invention has been described with reference to the structure disclosed herein, it is not confined to the details set forth and this application is intended to cover such modifications or changes as may come within the purposes of the improvements or the scope of the following claims.

What is claimed is:

1. A recording apparatus comprising:
means for forming a toner image;
a pair of rotatable members for gripping and conveying a recording material to heat and fix said toner image on said recording material;
means for heating at least one of said rotatable members;
means for rotating said rotatable members;
means for setting a first fixing condition capable of fixing said toner image onto a said recording material which is a synthetic resin film;
means for setting a second fixing condition capable of fixing said toner image onto a said recording material when it is a sheet of paper, the first fixing condition providing a rotational speed of said rotatable members lower than that of the rotatable members under the second fixing condition;
means for generating a signal indicative of the recording material being the synthetic resin film; and
means for selecting the first fixing condition in response to said signal.

2. A recording apparatus as defined in claim 1 wherein said heating means includes means for heating one of said rotatable members which contacts the surface of said recording material opposite to the toner image side thereof to a temperature higher than that of the other rotatable member contacting the toner image side on the recording material.

3. A recording apparatus as defined in claim 1, further including means for cleaning the surface of one of said rotatable members and means for moving said cleaning means to a position engaging the surface of said rotatable member when a toner image is to be fixed to the recording material which is a synthetic resin film.

4. A recording apparatus as defined in claim 3, further including means for applying an anti-offset liquid to the rotatable member which is adapted to engage said cleaning means, and wherein said cleaning means is adapted to engage the rotatable member upstream of a position at which said applying means supplies said anti-offset liquid to the rotatable member and downstream of a position at which the recording material is gripped between the pair of said rotatable members in the direction of rotation of said rotatable member.

5. A recording apparatus as defined in claim 4 wherein said cleaning means includes a movable cleaning web.

6. A recording apparatus as defined in claim 5 wherein the surface of the rotatable member engaged by said cleaning web is made of rubber.

7. A recording apparatus as defined in claim 3, further including a cleaning and applying roller for removing offset toner from the surface of the rotatable member which is to be cleaned by said cleaning means and also for applying the anti-offset liquid to said rotatable member, and wherein said heating means includes a source of heat disposed within said roller for heating said rotatable member through said roller.

8. A recording apparatus as defined in claim 1 wherein said toner image forming means includes color image forming means for forming a color toner image fixed to the resin film recording material.

9. A recording apparatus comprising:
means for forming a toner image;
fixing means including a rotatable fixing member for heating and fixing said toner image onto a recording material;
means for heating said rotatable fixing member;
means for controlling surface temperature of said rotatable fixing member;
means for controlling peripheral speed of said rotatable fixing member; and
selector means for setting the surface temperature and peripheral speed of said rotatable fixing member in accordance with the sort of said recording material, the set temperature and speed being together increased or decreased.

10. A recording apparatus as defined in claim 9 wherein said selector means includes means for decreasing both the surface temperature and rotational speed of said rotatable fixing member when the synthetic resin film rather than the thin paper is used as a recording material.

11. A recording apparatus as defined in claim 10 wherein said selector means includes means for informing or detecting that said recording material is a synthetic resin film to decrease the rotational speed and surface temperature of said rotatable fixing member.

12. A recording apparatus as defined in claim 9, further including a rotatable member cooperating with said rotatable fixing member to grip and convey said recording material therebetween, said rotatable fixing member being positioned to the surface of said recording material opposite to the toner image side, and said rotatable member being located to the toner image side of the recording material.

13. A recording apparatus as defined in claim 12, wherein said heating means heating the surface of said rotatable fixing member to a temperature higher than that of said rotatable member surface.

14. A recording apparatus as defined in claim 12, further including means for cleaning said rotatable member contacting the toner image, actuator means for moving said cleaning means toward and away from said rotatable member, and means for controlling the operation of said actuator means in accordance with the sort of said recording material.

15. A recording apparatus as defined in claim 14 wherein said controlling means causes said cleaning means to contact said rotatable member when said selector means operates to decrease the setting temperature and speed of said rotatable fixing member.

16. A recording apparatus as defined in claim 15 wherein said selector means includes means for decreasing both the rotational speed and surface temperature of said rotatable fixing member when the synthetic resin film rather than the thin paper is used.

17. A recording apparatus as defined in claim 16 wherein said selector means includes means for informing or detecting that the recording material used is a synthetic resin film, to decrease the setting temperature and speed of said rotatable fixing member.

18. A recording apparatus as defined in claim 9 wherein said toner image forming means includes means for forming a multi-color toner image to be fixed to the synthetic resin film when the recording material used is the synthetic resin film.

19. A recording apparatus comprising:
means for selectively forming a monochromatic or multi-color toner image;
fixing means including a rotatable fixing member for fixing the toner image formed by said toner image forming means onto a recording material;
means for controlling the peripheral speed of said rotatable fixing member;

means for cleaning the surface of said rotatable fixing member; and selector means for separating said cleaning means from said rotatable fixing member upon the monochromatic toner image fixing and for engaging said cleaning means with said rotatable fixing member upon multi-color toner image fixing.

20. A recording apparatus as defined in claim 19, further including means for setting the peripheral speed at a first speed when the toner image is colored and for setting it at a second speed when the toner image is monochromatic, said first speed being lower than said second speed.

21. A recording apparatus as defined in claim 20, further including means for heating said rotatable fixing member to heat and fix the toner image onto the recording material, means for controlling the surface temperature of said rotatable fixing member, and means for setting a first temperature when the toner image is colored and for setting a second temperature when the toner image is mono-colored, said first temperature being lower than said second temperature.

22. A recording apparatus comprising:

means for forming a toner image;

fixing means including a rotatable fixing member for fixing said toner image onto a recording material and means for cleaning said rotatable fixing member;

means for generating a signal representing that said toner image is to be fixed to the recording material which is in the form of a synthetic resin material;

means for setting a first cleaning mode in which said cleaning means acts on said rotatable fixing member when said toner image is to be fixed to the synthetic resin film and a second cleaning mode in which said cleaning means is separated from said rotatable fixing member to its inoperative position when said toner image is to be fixed to a sheet of paper as a recording material; and means for changing said setting means into the first cleaning mode in accordance with said signal.

23. A recording apparatus as defined in claim 22 wherein said toner image forming means includes means for forming a multi-color toner image.

24. A recording apparatus as defined in claim 7 wherein said heating means includes means for heating one of said rotatable members other than the rotatable member contacting said roller to a surface temperature higher than that of the rotatable member contacting said roller.

* * * * *